United States Patent [19]

Wolf et al.

[11] 4,188,885

[45] Feb. 19, 1980

[54] FAIL-SAFE MECHANICAL CODE CONVERTOR, MUNITION ARMING DEVICE USING SAME, AND METHOD OF TRANSMITTING CODED MECHANICAL INPUTS

[75] Inventors: Murray E. Wolf; Vincent Suozzo, both of Andover, Mass.

[73] Assignee: Avco Corporation, Wilmington, Mass.

[21] Appl. No.: 851,920

[22] Filed: Nov. 16, 1977

[51] Int. Cl.[2] ..... F42C 17/00

[52] U.S. Cl. ..... 102/221; 89/6; 70/313

[58] Field of Search ..... 70/313, 333 R; 89/6; 102/221, 222

[56] References Cited

U.S. PATENT DOCUMENTS

| | | | |
|---|---|---|---|
| 3,371,579 | 3/1968 | Kinzelman | 89/6 |
| 3,602,021 | 8/1971 | Martins | 70/313 |
| 3,800,577 | 4/1974 | Norremark | 70/313 |

*Primary Examiner*—David H. Brown
*Attorney, Agent, or Firm*—Abraham Ogman

[57] ABSTRACT

A mechanical code convertor, munition arming device using same, and method of transmitting coded mechanical inputs are provided wherein such code convertor has an input member adapted to receive complementary mechanical driving movements, a mechanically locked output member, and apparatus mechanically connected between the input and output members for unlocking the locked output member and providing a desired motion thereof in response to correctly coded mechanical driving movements while maintaining such output member mechanically locked in response to incorrectly coded mechanical driving movements.

18 Claims, 20 Drawing Figures

FAIL-SAFE MECHANICAL CODE CONVERTOR, MUNITION ARMING DEVICE USING SAME, AND METHOD OF TRANSMITTING CODED MECHANICAL INPUTS

BACKGROUND OF THE INVENTION

1. Field of the Invention

This invention relates to means enabling controlled arming or activation of devices capable of instantaneous release of substantial energy; and in particular, this invention relates to such means as applied to nuclear devices whether used as munitions, in power generating equipment, or in any other type of equipment.

2. Prior Art Statement

Most munitions which are capable of producing substantial devastation are usually provided with some type of actuation or arming mechanism and as the magnitude of the devastation which may be produced by each of such munitions increases the need to provide fail-safe operation of the arming mechanism also increases. It is known in the art to provide a fail-safe device for the arming mechanism of a munition and each of such known devices has an output member which is directly coupled to a drive system which is employed to provide an arming function. In one type of known device coded signals are used to remove barriers or locks on such output member. In another type of known device signals from stored electronic decoding logic are used to remove such barriers or locks from such output member. Accordingly, an inherent deficiency of known prior art arming devices is that such devices have an output member which is used to provide the arming function which is directly coupled to a drive system therefor.

SUMMARY OF THE INVENTION

It is a feature of this invention to provide a device which will also be referred to as a mechanical code convertor which overcomes the above-mentioned deficiency.

Another feature of this invention is to provide a fail-safe mechanical code convertor having input means for receiving complementary mechanical driving movement and having mechanically locked output means; and, such convertor provides motion of the locked output means in response to correctly coded mechanicl driving movements yet maintains the output means mechanically locked in reponse to incorrectly coded mechanical driving movement whereby motion of the locked output means is only possible by driving through the code and hence through the cooperating structural components of the converter. This concept of driving through the code inherently means that incorrectly coded mechanical driving movement of the input means does not impart a torque to the output means and also causes a lock-up of the convertor whereby motion of the output means thereof cannot take place.

Another feature of this invention is to provide a code convertor of the character mentioned in which the complementary mechanical driving movements are in the form of binary mechanical drive pulses.

Another feature of this invention is to provide a mechanical code convertor of the character mentioned which employs commonly known mechanical components.

Another feature of this invention is to provide a code convertor of the character mentioned in which the probability of actuation of output means thereof using an incorrect code is of the order of one in one million and such convertor may be readily modified so that such probability is of the order of one in one billion.

Another feature of this invention is to provide a self-contained code convertor of the character mentioned which operates independently of a stored energy source therewithin for moving its output means.

Another feature of this invention is to provide a fail-safe method of transmitting a coded mechanical input employing a code convertor of the character mentioned.

Another feature of this invention is to provide in a munition having arming means and a device for arming the arming means, the improvement in such device which includes a fail-safe mechanical code convertor of the character mentioned.

Therefore, it is an object of this invention to provide a fail-safe mechanical code convertor, munition arming device using same, and method of transmitting coded mechanical inputs having one or more of the novel features set forth above or hereinafter shown or described.

Other objects, features, details, uses, and advantages of this invention will become apparent from the embodiments thereof presented in the following specification, claims, and drawings.

BRIEF DESCRIPTION OF THE DRAWINGS

The accompanying drawings show a present preferred embodiment of this invention, in which.

DESCRIPTION OF THE PREFERRED EMBODIMENT

Figure 1:
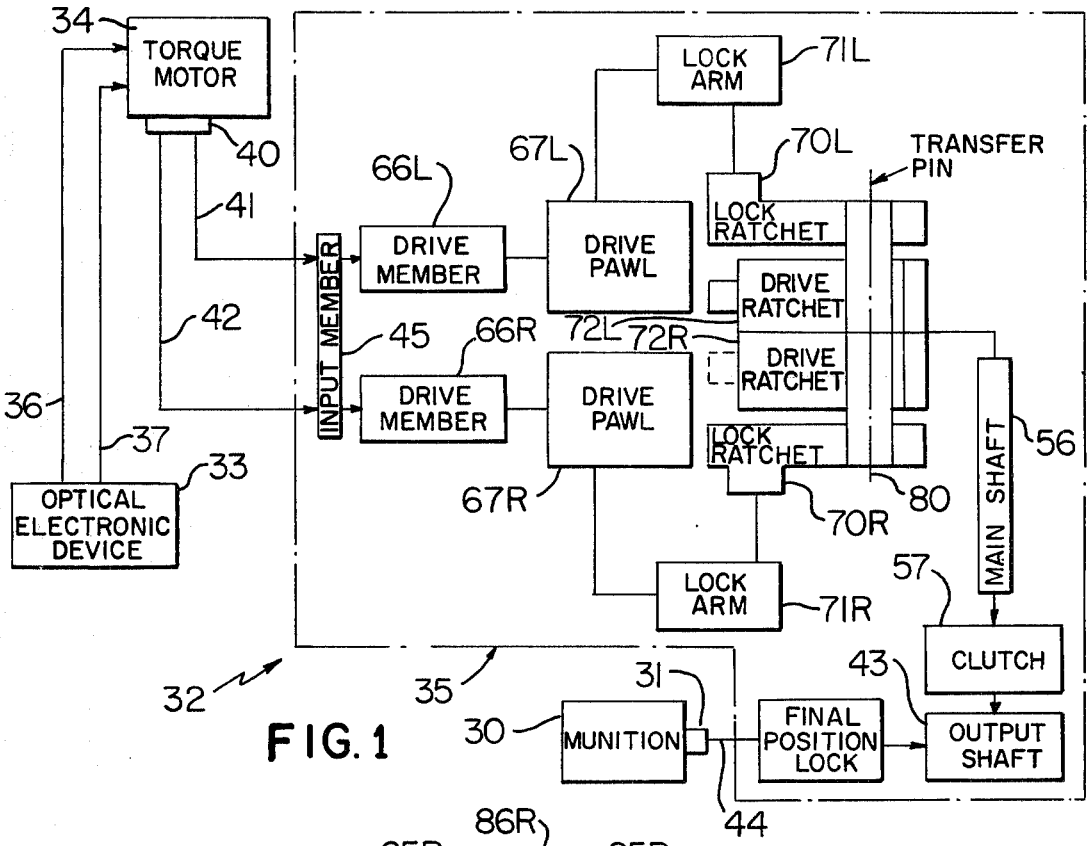
FIG. 1 is a schematic presentation of a munition having arming means and a device of this invention for arming such arming means including an exemplary fail-safe mechanical code convertor of this invention which is shown within a schematic block defined by dot-dash lines.

Reference is now made to FIG. 1 of the drawing which illustrates an arming and fusing device for a munition device which is indicated by a rectangular block 30 and such munition has suitable arming means which in this disclosure is shown as a rotatable shaft 31. The munition 30 has an arming device made in accordance with this invention which is comprised of the remainder of the components illustrated in FIG. 1 and such device is designated generally by the reference numeral 32. The arming device 32 has means for providing or producing complementary mechanical driving movements and such means comprises a device indicated schematically by a rectangular block 33 and a cooperating torque producing device in the form of a torque motor 34. The arming device 32 also comprises an exemplary fail-safe mechanical code convertor of this invention which is designated generally by the reference numeral 35, and in FIG. 1 the code convertor 35 is outlined by dot-dash lines and key components thereof are illustrated within the area defined by such dot-dash lines.

The device 33 of this example is in the form of an optical-electronic system or device which is operatively connected to the torque motor 34 by a pair of leads 36 and 37. The device 33 is particularly adapted to receive a two-channel complementary optical signal in code form with the code being any desired binary combination and a particular code for the device 33 and convertor 36 will be described in detail subsequently. The device 33 converts the optical code into a series of positive and negative electrical signals using known techniques and commercially available electronic circuits and such signals are transmitted through leads 36 or 37 respectively to the torque motor 34. The optical signals may be provided to device 33 using any suitable technique known in the art and such device is provided with electric power from a suitable electrical power source, not shown.

The torque motor of this example is a commercially available electromagnetic direct electric current (DC) torque motor 34 which converts the positive and negative electrical sequence or signals into a series of corresponding clockwise and counterclockwise rotations of an output shaft 40 of such motor. In FIG. 1, a clockwise rotation is indicated schematically by a line 41 while a counterclockwise rotation is indicated schematically by a line 42.

The shaft 40 of motor 34 is rotated either clockwise or counterclockwise in response to positive or negative electrical signals respectively from the device 33 whereby the shaft 40 provides what is popularly referred to in the art as binary mechanical driving movements or pulses. The reference to binary means that the movements are applied in opposite directions or senses and in the case of rotatable shaft 40 the movements are in the form of either clockwise or counterclockwise rotations. The reference to the driving movements being in the form of pulses encompasses the concept that the torque motor 34 may be energized for a predetermined time interval to provide power and rotation in a particular direction; however, this time interval is sufficiently large that in actuality the cooperating actions of mechanical components within the code convertor 35 define a particular mechanical pulse.

The code convertor 35 of the arming device 32 has a rotatable output shaft 43 which is operatively connected by suitable connection means 44 to the rotatable shaft 31 of the munition 30. The output shaft 43 is maintained in a locked condition, i.e., nonrotatable condition; and rotation thereof can only be achieved as will now be described. In particular, the physical construction of the cooperating components of the code convertor 35 is such that all motion into the code convertor 35, from the torque motor 34, can only be transmitted to its output shaft 43 for rotation thereof by physical transmission through the code convertor 35. The uniqueness of the code convertor 35, the arming device 32 using same, and the method of transmitting a coded mechanical input in each instance lies in the basic premise that the output shaft 43 of convertor 35 can only be operated or rotated in response to a correct code being supplied to the mechanical code convertor 35. However, once an incorrect code and hence an incorrect mechanical input is provided and attempted to be transmitted through the code convertor 35 such convertor self locks or self jams and the output shaft 43 is retained in its locked condition. With the shaft 43 maintained in its locked condition motion cannot be imparted to the mechanical shaft 31 of the munition 30 thereby preventing the munition 30 from being armed for subsequent activation using other suitable means.

The code convertor 35 has input means in the form of a rotatable input member 45 (see FIGS. 1, 2, and 4) which is detachably fixed by a pin 46 to the shaft 40 of the torque motor 34 and thus receives complementary mechanical drive movements from such torque motor. Accordingly, the member 45 is adapted to be rotated in one direction, clockwise, in response to one set of binary mechanical drive pulses of the torque motor 34 and is adapted to be rotated in an opposite direction, counterclockwise, in response to the other set of binary mechanical drive pulses. The clockwise and counterclockwise rotations of input member 45 are indicated schematically in FIG. 1 by those portions of lines 41 and 42 respectively disposed on the side of member 45 opposite from the torque motor 34.

Figure 2:
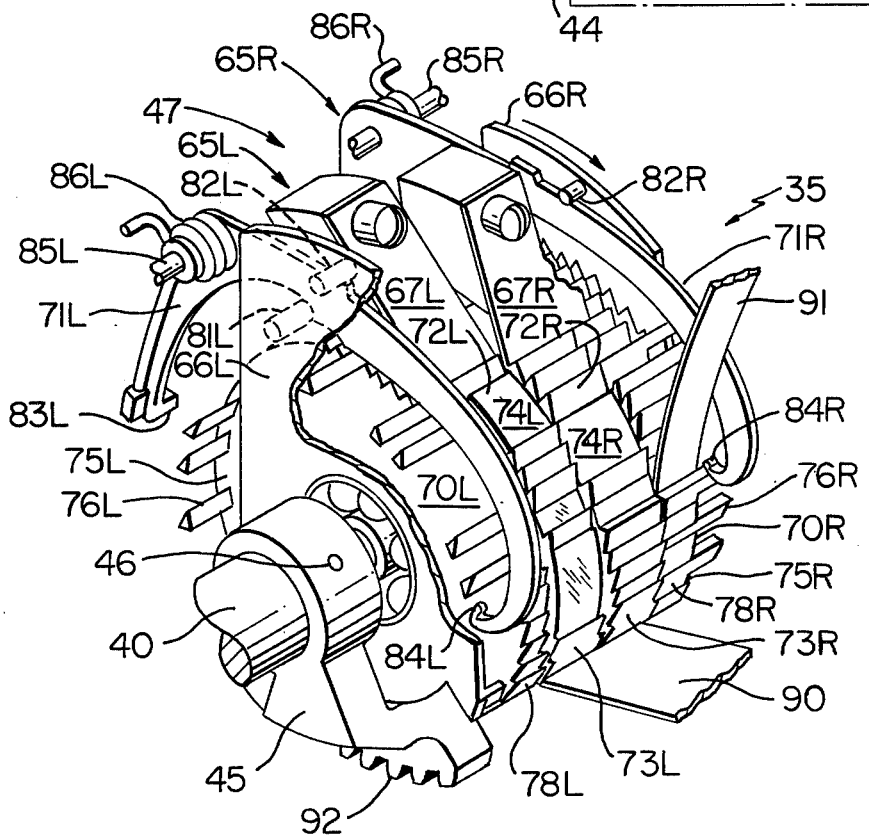
FIG. 2 is a perspective view with parts broken away and parts in cross section, particularly illustrating certain components of the code convertor.
Figure 3:
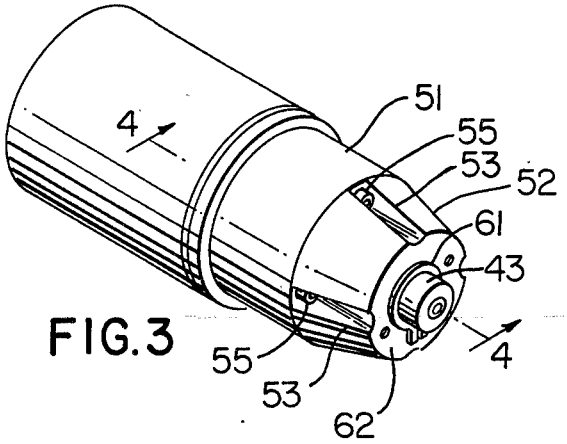
FIG. 3 is a perspective view of the device for arming which is illustrated schematically in FIG. 1.
Figure 4:
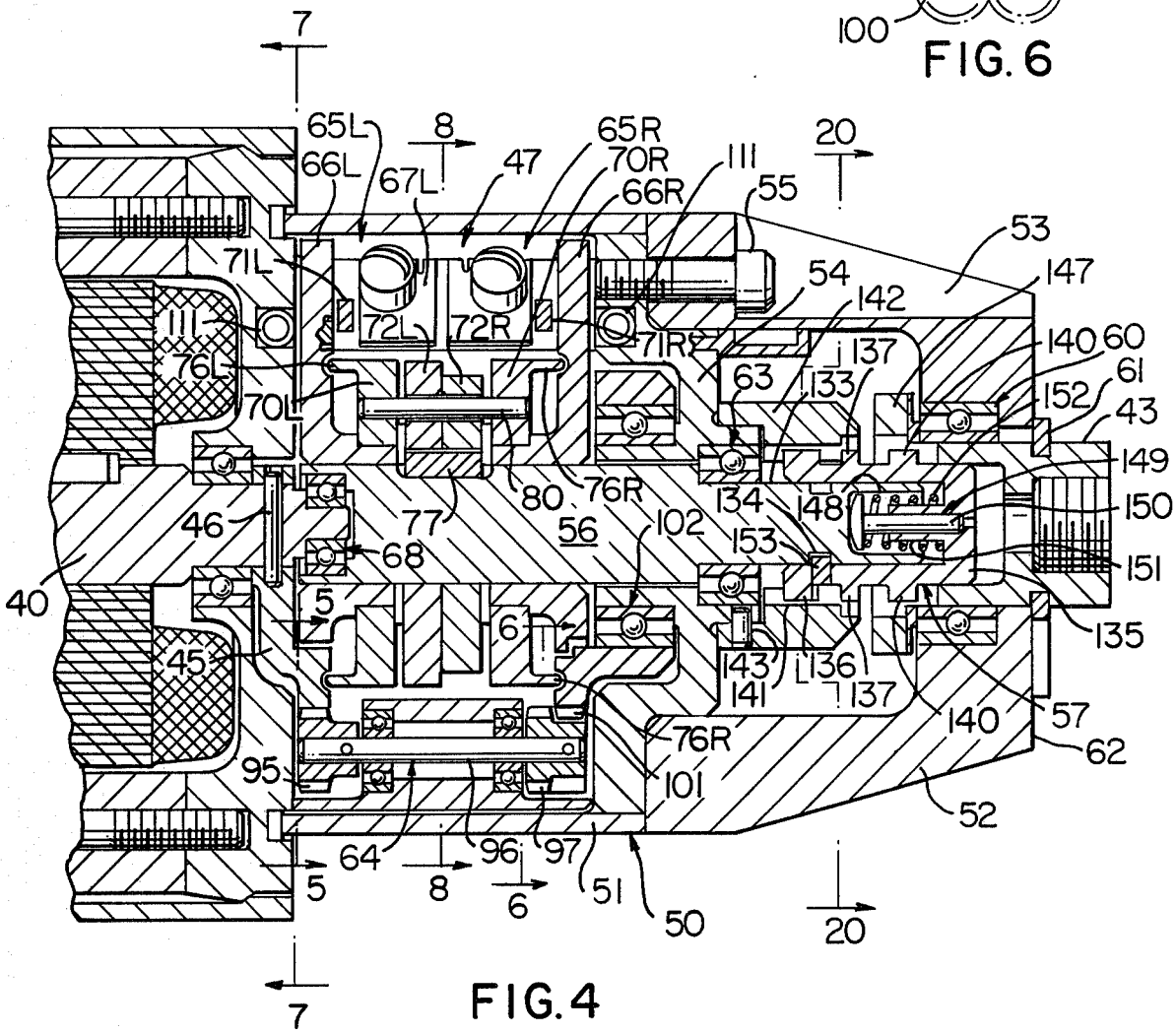
FIG. 4 is an enlarged cross-sectional view taken essentially on line 4—4 of FIG. 3 and primarily illustrating component parts of the code convertor.
Figure 7:
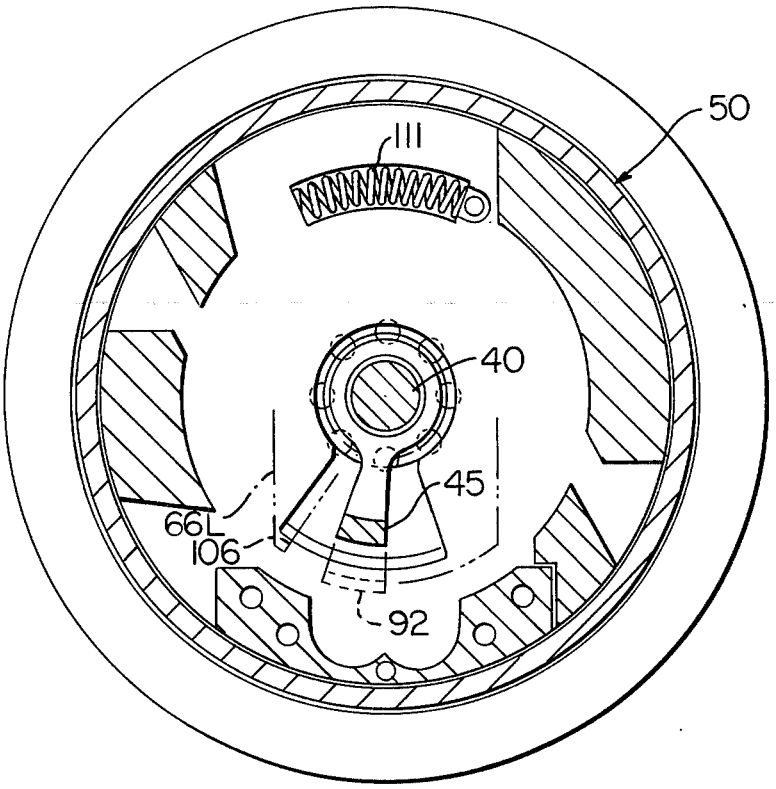
FIG. 7 is a view taken essentially on the line 7—7 of FIG. 4.

The code convertor 35 comprises apparatus indicated generally by the reference numeral 47 in FIG. 2 of the drawings and such apparatus is mechanically connected between the input member 45 and the output shaft 43 for unlocking such output shaft to provide rotary motion thereof in response to correctly coded mechanical drive movements while maintaining the output shaft 43 mechanically locked in response to incorrectly coded mechanical drive movements. As best seen in FIG. 4 the input member 45, output shaft 43, and apparatus 47 disposed therebetween are housed within a housing and support structure indicated by the general reference numeral 50 and such structure is comprised of a plurality of components including a cylindrical housing member 51 and a substantially frustroconical housing member 52 provided with a plurality of four spaced cutout grooves 53 in its periphery. The member 51 has a structural web-like member 54 suitably fixed thereto and the member 52 is fixed to the member 51 by a plurality of threaded bolts 55 which are inserted through grooves 53, extend through associated openings in the housing member 52, and are threadedly received in cooperating threaded openings in member 54.

The code convertor 35 has a main shaft 56 which is rotatably supported centrally within the structure 50 and such shaft has a clutch mechanism or clutch 57 suitably operatively connected thereto; and, the clutch 57 has the rotatable output shaft 43 suitably operatively connected thereto at its terminal outer end and the operation of clutch 57 and manner of connecting output shaft 43 thereto will be described subsequently. The output shaft 43 is rotatably supported in an anti-friction manner relative to member 52 by a ball bearing assembly 60 and the output shaft 43 is prevented from moving axially by a snap ring type retainer 61 suitably fixed to the terminal outer face 62 of the member 52. The shaft 56 is supported by the ball bearing assemblies 63 and 68 and the shaft 56 in turn supports clutch 57.

The apparatus 47 which acts between the input member 45 and output shaft 43 of the code convertor may be considered as comprising a mechanical linkage 64 (FIGS. 4 & 5) for reversing the direction of force application by member 45 of mechanical input pulses of a particular sense or direction of rotation, the main shaft 56, the clutch 57, and a pair of mechanisms acting between members 45 and 43 and shown in the drawings as a left mechanism and a right mechanism. Because these mechanisms are, in essence, mirror images of each other, each mechanism will be designated generally by the same reference numeral 65 followed by the letter "L" for the left mechanism and the letter "R" for the right mechanism and similar components of the left and right drive mechanisms will be designated by the same reference numerals followed by an appropriate letter L or R depending upon whether the component comprises the left mechanism 65L or the right mechanism 65R respectively.

Referring now to FIGS. 1, 2, and 4 it is seen that the left drive mechanism 65L comprises a drive member 66L in the form of a plate 66L which is rotatable through a limited arc length about the main shaft 56, a drive pawl 67L which is suitably detachably fixed to the member 66L for movement therewith, a coded lock ratchet 70L rotatably supported about the main shaft 56, a lock arm 71L, and a coded drive ratchet 72L.

Similarly, it will be seen that the right drive mechanism 65R comprises a right drive plate or member 66R which is rotatable through a limited arc length about the main shaft 56, a drive pawl 67R which is suitably detachably fixed to the member 66R for movement therewith, a coded lock ratchet 70R rotatably supported about the main shaft 56, a lock arm 71R, and a coded drive ratchet 72R.

The coded drive ratchets 72L and 72R are made with the predetermined code defined or made as a part of their configurations and in this example teeth 73L and 73R of the drive ratchets 72L and 72R are machined with predetermined spacing as shown typically at 74L and 74R in FIG. 2, for example, to reflect the code. Similarly, the physical construction of the lock ratchets 70L and 70R is such that locking protrusions or projections 76L and 76R respectively extend from their outside planar surfaces 75L and 75R. These locking projections are provided in accordance with the code and cooperate with the code as provided on the drive ratchets 72L and 72R. In addition to these locking projections the lock ratchets 70L and 70R have a full set of teeth 78L and 78R. It will also be noted that in FIGS. 8 and 10 through 13 the locking projections 76L and 76R are indicated by darkening the crests or apexes of certain teeth of the lock ratchets 70L and 70R.

The coded drive ratchets 72L and 72R are keyed to the main shaft 56 by a key 77, and the lock ratchets 70L and 70R are fixed together by at least one transfer pin and in this example by a pair of transfer pins 80, FIGS. 1 and 4. The drive members 66L and 66R have lower cam members 81L and 81R respectively suitably fixed thereto for the purpose of camming an associated lock arm 71L or 71R in a manner to be described in detail subsequently; and, such drive members 66L and 66R also have upper cam member 82L and 82R respectively for the purpose of preventing uncontrolled motion of associated lock arm 71L or 71R. The uncontrolled motion referred to may be due to vibration or other loads likely to be imposed on the code convertor 35.

The lock arms 71L and 71R have stops 83L and 83R respectively at one end thereof and hook-like locking projections 84L and 84R respectively at an opposite end thereof. The purpose of these components 83L–83R and 84L–84R will be presented in detail subsequently in connection with the operation of the code convertor 35.

Figure 9:
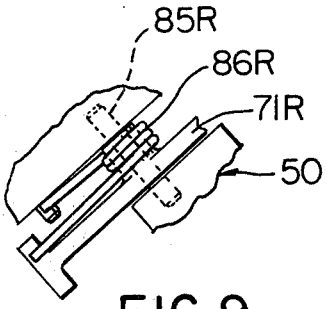
FIG. 9 is a fragmentary view particularly illustrating a typical torsion spring employed on a lock arm of the code convertor.

The lock arms 71L and 71R are supported for pivoting movements by pivot rods or pins 85L and 85R respectively with the rods 85L and 85R being supported by the structure 50. The lock arms 71L and 71R also have a pair of torsion springs 86L and 86R respectively (FIGS. 2, 8 and 9) which are provided for the purpose of continuously biasing their associated locking arm so that a hook thereof is brought into hooking or locking engagement with a projection of an associated lock ratchet to lock-up the code convertor 35 in the event of an incorrect mechanical code movement and in a manner to be described in detail subsequently.

Figure 8:
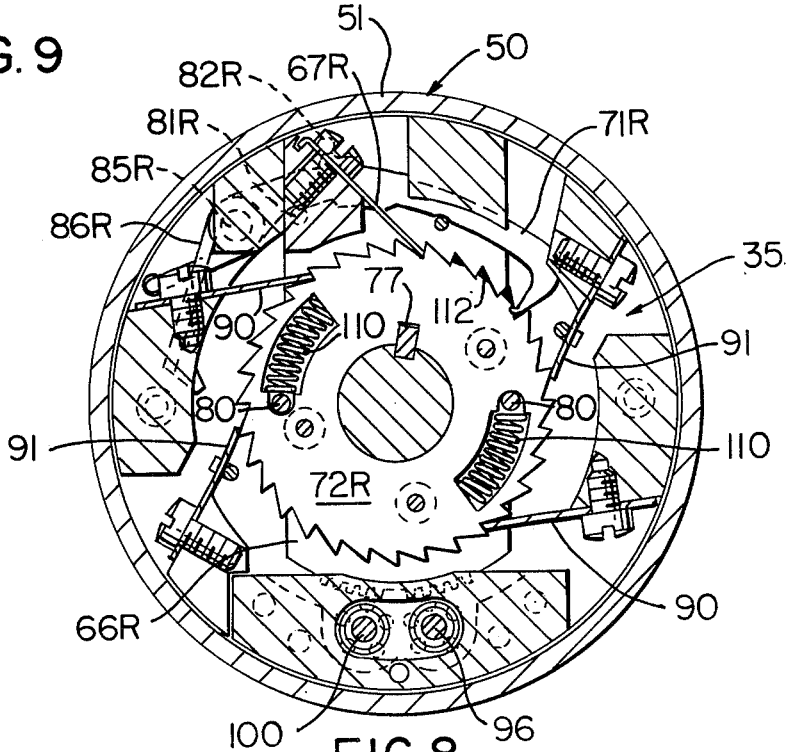
FIG. 8 is a view taken essentially on the line 8—8 of FIG. 4.

As best seen in FIGS. 2 and 8 the code convertor 35 has a pair of diametrically disposed locking pawls 90 extending across substantially the full width of the drive ratchets 72L and 72R; and, such code convertor 35 also has a pair of diametrically disposed locking pawls 91 associated with each lock ratchet 70L and 70R respectively. The manner in which these locking pawls 90 and 91 operate during operation of the code convertor 35 will be described in detail subsequently.

Figure 5:
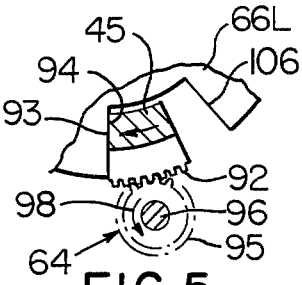
FIG. 5 is a fragmentary view with parts in elevation and parts in cross section taken essentially on line 5—5 of FIG. 4.

Having briefly described certain main components of the code convertor 35, reference is now made to FIGS. 2 and 4–7 for a description of the mechanical linkage 64 which enables the single rotatable input member 45 which actuates linkage 64 to be rotated in either direction yet provide rotation of the main shaft 56 always in one direction. Referring now to FIGS. 2 and 5 it is seen that clockwise rotation of the member 45 provides movement of its integral outer gear segment 92 in a clockwise direction causing a surface 93 of the member 45 to engage a cooperating surface 94 of drive member 66L thereby driving the drive pawl 67L fixed to member 66L clockwise. Simultaneously with this clockwise rotation of the gear segment 92 it will be seen that gear segment 92 engages a gear 95 which is fixed to one end of a shaft 96 whereby gear segment 92 rotates gear 95 and shaft 96 counterclockwise as shown by the arrow 98 in FIG. 5. The other end of shaft 96 has a gear (FIG. 6) 97 suitably fixed thereto which engages a gear 99 to rotate gear 99 clockwise. The gear 99 is fixed on a shaft 100 which rotates with gear 99 and gear 99 meshes with a gear segment 101 which is rotatably supported by a ball bearing assembly 102 on structural web member 54. The gear segment 101 moves counterclockwise under the action of gear 99 such that a driving surface 103 of member 101 is moved away from a surface 104 of the right drive member 66R whereby the member 66R is not effective in providing any motion of its drive pawl 67R and associated components because drive member 66L only moves a particular predetermined indexing increment and the gear segment 101 merely moves within a slot 105 provided in the right drive member 66R and is not effective in moving the right drive member 66R.

Conversely, counterclockwise movement of the rotatable input member 45 causes surface 103 of gear segment 101 to engage surface 104 of the right drive member 66R and provide clockwise rotation thereof while the member 45 moves within a slot 106 of the drive member 66L whereby the left drive member 66L and its drive pawl 67L remain stationary in a similar manner as previously described.

The construction of the code convertor 35 is such that each drive pawl 67L or 67R rotates its ratchet assembly and the ratchets are designed so that with a correct code they cooperate to rotatably advance the main shaft 56 in one direction in an indexing manner. With an incorrect code the code convertor 35 self locks or jams. It will be appreciated that advancing movement of the main shaft 56 is accomplished by having the coded drive ratchets made so that a tooth is presented to one of the pawls at a time. If that particular pawl is actuated, the shaft 56 is advanced or indexed.

The lock ratchets 70L and 70R are configured to have the code machined on the outside face. The code is in the form of a mechanical interference 76L and 76R with the lock arms 71L and 71R. If the correct drive pawl is actuated, the adjacent lock arm will be cammed to a noninterfering position with the lock ratchet protrusion 76L or 76R. No interference is presented to the other lock arm which remains stationary. If an incorrect code is received, the main shaft 56 will not rotate (no tooth will be presented to the drive pawl), the lock arm will not be lifted, the lock ratchets will be rotated into permanent interference with the lock arm, and the unit will be locked up.

As long as the code is correct, one or the other of the coded drive ratchets will be advanced by its associated pawl and the correct lock arm will be cammed by its cam pin 81L or 81R so that such correct lock arm allows free movement. The transfer pins 80 allow the drive ratchets 72L and 72R to carry both of the lock ratchets 70L and 70R therewith and springs 110, FIG. 8, are provided to maintain the relative position of all ratchets and aid in resetting ratchets. This will be discussed later in more detail. From this description it is seen that as long as all four ratchets 70L, 70R, 72L, and 72R advance in the manner described the main shaft 56 will be rotated through the key 77.

Each step of indexing movement of the code convertor is controlled against overshooting by an associated holding projection either 83L or 83R of a lock arm 71L or 71R engaging the full set of lock ratchet teeth 78L or 78R. The locking pawls 90 maintain the coded drive ratchets in their newly indexed position. After each indexing movement the input member 45 of the code convertor 35 is driven back to its neutral position by return springs 111 (FIGS. 4 and 7) and the lock arms 71L and 71R are returned to their initial positions by torsion springs 86L and 86R respectively and their respective cam pins 82L and 82R.

Figure 10:
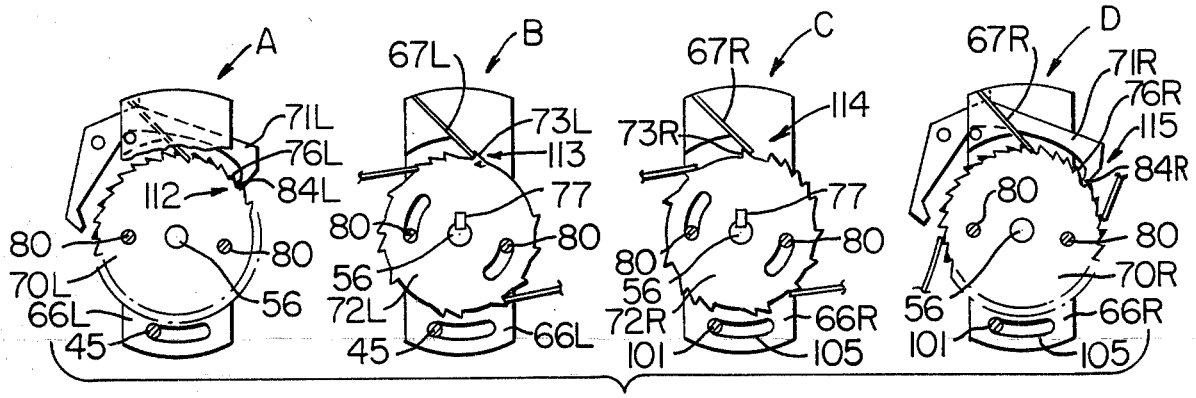
FIGS. 10, 11, and 12 are schematic type views of the initial, midstroke, and final positions respectively of certain components of the code convertor during a normal operating cycle.
Figure 11:
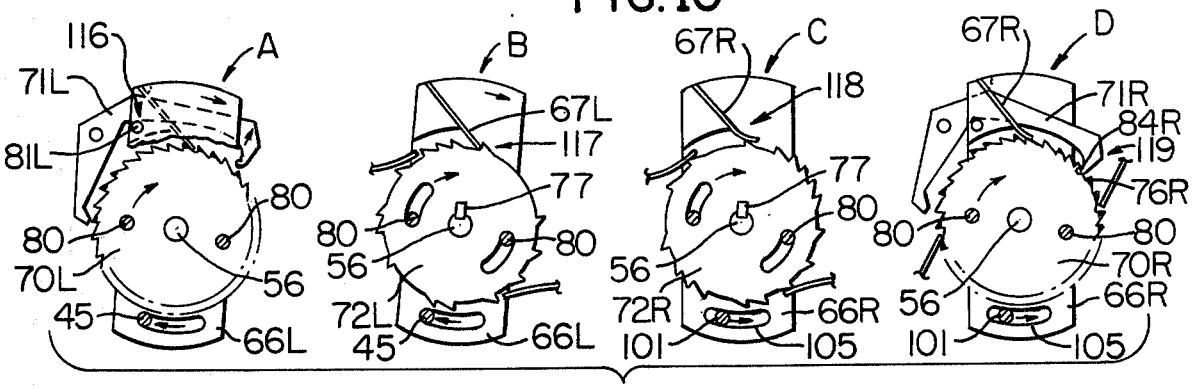
Figure 12:
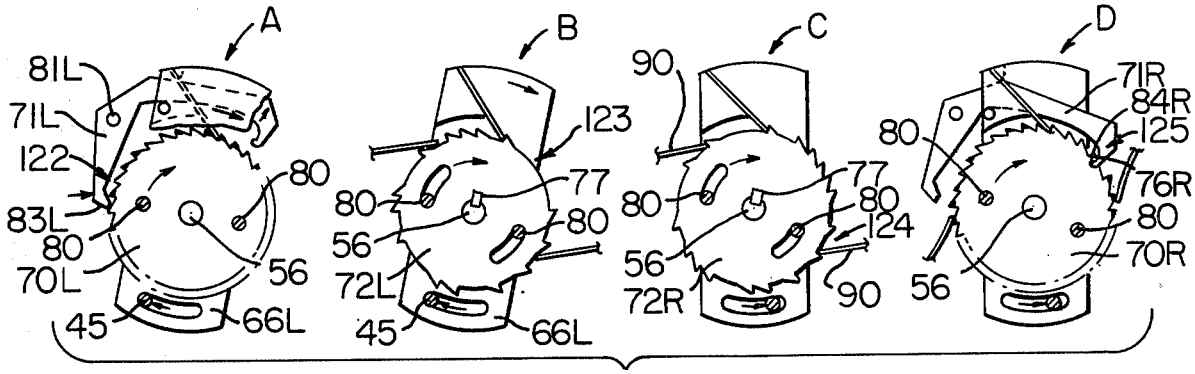

Having described the overall construction and arrangement of the cooperating components of the apparatus 47 comprising the code convertor 35 of this invention and certain ones of the components associated therewith the detailed description will now proceed with a functional description of apparatus 47 during a normal operating cycle and for this description reference is made to FIGS. 10, 11, and 12 of the drawings. In a normal operating cycle the associated drive ratchet either 72L or 72R rotates the main shaft 56 through the key 77 and rotates both lock ratchets 70L and 70R by means of the dual transfer pins 80. Views A, B, C, and D of the same components will be presented in each of FIGS. 10–12 and described at each step of the correct code operating cycle.

Particular reference is now made to FIG. 10 which represents the initial position at the start of a binary mechanical drive pulse as applied by clockwise movement of member 45, as seen in FIG. 2, to provide clockwise rotation of drive member 66L. FIG. 10, view A, illustrates the locking hook 84L of the left lock arm 71L in potential interference with a protrusion 76L of the left lock ratchet 70L as indicated by the darkened tooth crest at 112. View B illustrates that a tooth 73L is presented to the left drive pawl 67L and as shown at 113. View C illustrates at 114 that a tooth 73R of the right drive ratchet 72R is is missing and therefore not presented to the right drive pawl 67R. View 10D illustrates at 115 that there is no potential interference with a locking hook 84R of the right lock arm 71R inasmuch as a projection 76R does not extend from the lock ratchet at this location and as indicated by the absence of a darkened tooth crest adjacent the locking hook 84R. The cooperating action of components as illustrated in FIG. 10 indicates that there will be a rotary indexing movement of the main shaft 56 produced by left drive pawl 67L.

Reference is now made to FIG. 11 of the drawings which illustrates what will be referred to as a mid-stroke position of a correct operating cycle. View 11A illustrates that the left lock arm 71L is moved to a noninterfering position by the action of the associated cam pin 81L engaging the lock arm as indicated at 116. View 11B shows the drive member 66L rotating the drive pawl 67L which rotates the coded drive ratchet 72L by engaging a tooth thereof which is present in accordance with the code and as shown at 117 whereby the main shaft 56 is rotated through the key 77. View 11C shows that the right drive member 101 rotates in its clearance slot 105 so that the right drive pawl 67R remains in position and does not move as illustrated at 118. View 11D illustrates that the right lock ratchet 70R rotates by means of the transfer pins 80. The right lock arm 71R is not cammed out but there is no interference by locking hook 84R thereof to prevent motion of the right lock ratchet 70R because in accordance with the correct code, a projection 76R is not present thereon and as indicated by the absence of a darkened tooth crest as shown at 119.

FIG. 12 represents the end of a normal drive stroke; and, in view 12A it is seen that the ratchet overtravel stop 83L of the left lock arm 71L is moved in position by the action of cam pin 81L, as shown at 122 to thereby prevent further indexing movement of the apparatus 47. View 12B illustrates the left coded drive ratchet 72L at the end of a drive stroke or mechanical drive pulse and in this position the main shaft 56 has been rotated or indexed what amounts to one mechanical increment of the code, and as shown at 123. View 12C shows that the locking pawls 90 hold the drive ratchets 72L and 72R in their newly indexed position by engaging associated teeth of such ratchets as shown at 124. View 12D illustrates that the right lock arm 71R is in potential interference with a projection 76R shown at 125 by darkening on a tooth crest beneath the locking hook 84R of arm 71R.

Figure 13:
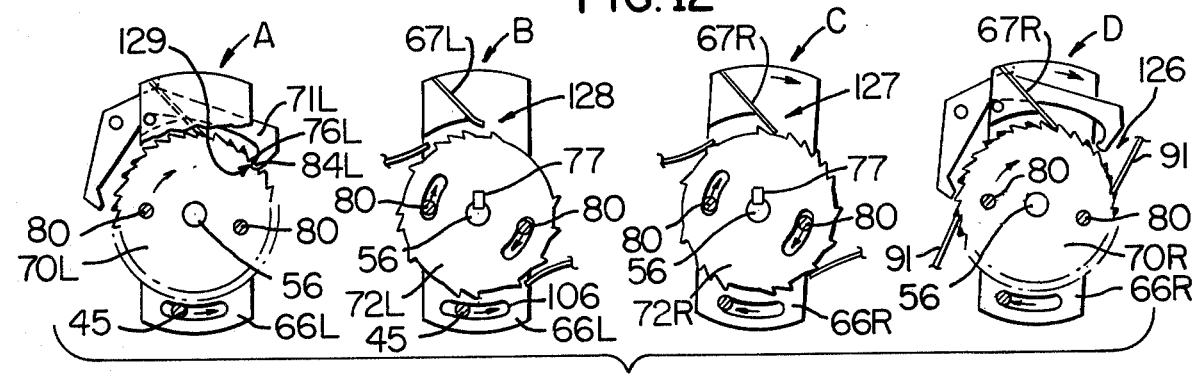
FIG. 13 is a view similar to the views in each of FIGS. 10–12 illustrating the positions of the same components in what will be referred to as an abort mode cycle.

A cycle where an improper code is received by the torque motor 34 and hence code convertor 35, will be referred to as an abort mode cycle. During such abort mode cycle, only the lock ratchets rotate and for this presentation reference is now made in FIG. 13 of the drawing. The illustration of FIG. 13 presents the result of an incorrect code sequence starting from the initial position illustrated in FIG. 10. In considering FIG. 13 view D it will be seen that the right drive member 66R rotates its associated drive pawl 67R which in turn rotates the associated right lock ratchet 70R. Pawls 91 which may also be referred to as abort mode locking pawls 91 hold the ratchets in the partially advanced position and are illustrated at 126. View 13C shows that the right drive member 66R rotates the right drive pawl 67R; however, the right coded right drive ratchet 72R does not move because a tooth is missing as indicated at 127 and such tooth is obviously missing because of an incorrect code. Accordingly, the main shaft 56 does not receive torque and thus does not move. View 13B illustrates that the drive member 45 rotates in its clearance slot 106 so that the associated left drive pawl 67L remains in position as indicated at 128. View 13A illustrates that the left lock ratchet 70L rotates a partial cycle being limited by the locking hook 84L of the left lock arm 71L engaging coded protrusion 76L in the left lock ratchet 70L as indicated at 129 whereby rotation of the right lock ratchet 70R is also prevented inasmuch as the right lock ratchet 70R is keyed to the left lock ratchet by transfer pins 80.

The physical construction of the code convertor 35 and in particular the apparatus 47 thereof is such that in this aborted position the lock ratchets 70L and 70R are captured between associated locking pawls 91 and locking hook 84L of the left lock arm 71L whereby further advancement of the drive ratchets 72L and 72R in either direction cannot occur until a manual unlock is acheived and a reset operation is performed. It will also be appreciated that reverse rotation of the main shaft 56 is always prevented from taking place by the action of the pawls 90.

In FIGS. 10–12 indexing rotary movement has been described during a correct code producing rotation of left drive member 66L and, an abort mode operation has been presented by providing rotation of the right drive member 66R in response to an incorrect code. However, it will be appreciated that for the opposite code the reverse procedure could have been followed, i.e., rotate drive member 66R for correct code and drive member 66L for abort mode and the same results would take place.

The construction of the components of the exemplary code converter 35 of this invention requires that 20 bits of coded information be correctly received which provide indexing rotation of shaft 56, in order to make it possible for shaft 56 to rotate further; and, during this indexing rotation of main shaft 56 such shaft is incrementally indexed a total of 225 degrees. This is achieved because 32 lock ratchet teeth are provided and such bit of coded information results in a drive pulse and an indexing movement which rotates shaft 56 one tooth increment whereby 20/32 of a revolution equals 225 degrees rotation. However, throughout this entire 225 degree rotation of the main shaft 56 the output shaft 43 remains stationary and locked to the support structure 50 by the clutch mechanism 57.

Figure 15:
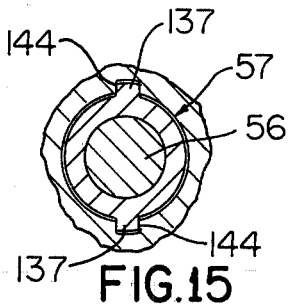
FIG. 15 is a view taken essentially on the line 15—15 of FIG. 14.

The operation of the clutch mechanism will now be described in detail and for this description reference is made to FIGS. 14, 15, 16, and 17 of the drawings. The clutch 57 operates between the main shaft 56 and the output shaft 43; and, the output shaft 43 is supported for substantially anti-friction rotation by ball bearing assembly 60 while shaft 56 is similarly supported by ball bearing assembly 63 as previously indicated. The main shaft 56 has a reduced diameter portion 133 of right circular cylindrical peripheral outline which is provided with a cam track 134. The cam track 134 is formed in portion 133 of the main shaft 56 utilizing any suitable technique and preferably such cam track is machined therein. The clutch mechanism 57 has a main movable member 135 provided with three sets of projections along the axial length thereof including a plurality of two projections 136, also see FIG. 20, which are spaced 180 degrees apart and projections 136 are at the inner end of the member 135, a plurality of two projections 137 spaced 180 degrees apart in the central portion of the member 135 and as shown in FIG. 15, and a plurality of two projections 140 also spaced 180 degrees in the central portion of the member 135 but closer to output shaft 43 than projections 137.

Figure 14:
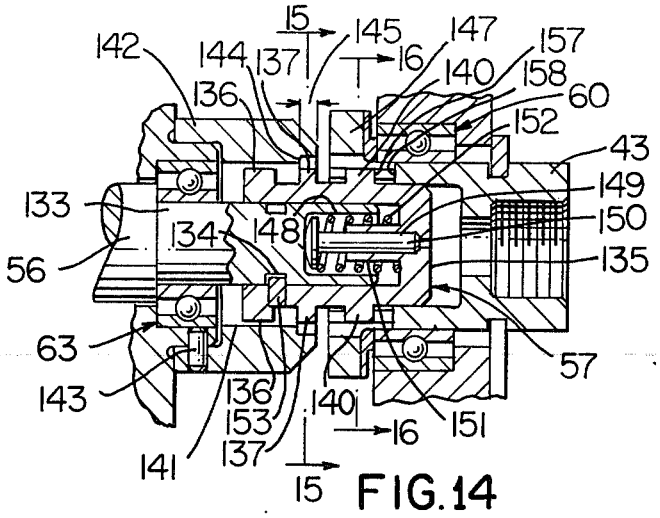
FIG. 14 is a fragmentary cross-sectional view illustrating locked output means in the form of a locked output shaft of the convertor which is locked to the structural housing of the convertor by a clutch mechanism operatively connected to such output shaft.
Figure 16:
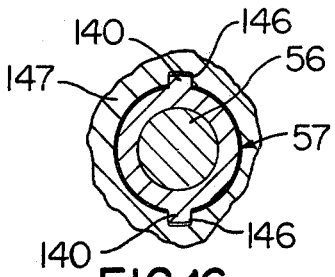
FIG. 16 is a view taken essentially on the line 16—16 of FIG. 14.
Figure 17:
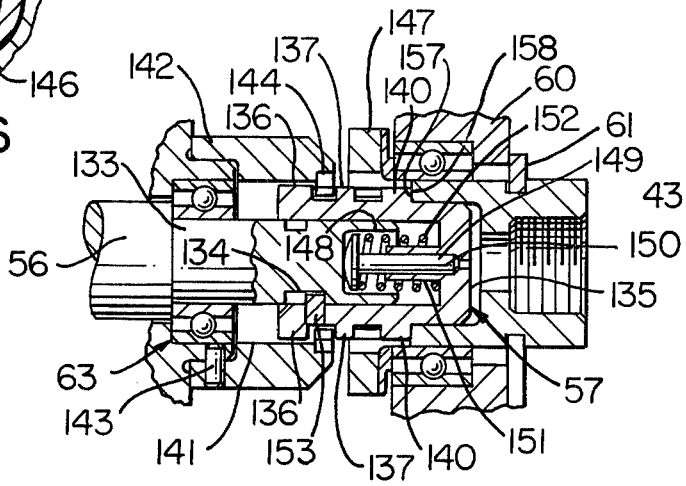
FIG. 17 is a view similar to FIG. 14 and particularly illustrating the clutch mechanism uncoupled from the structural housing of the convertor and operating to hold the output shaft coupled to the main shaft of the convertor.
Figure 20:
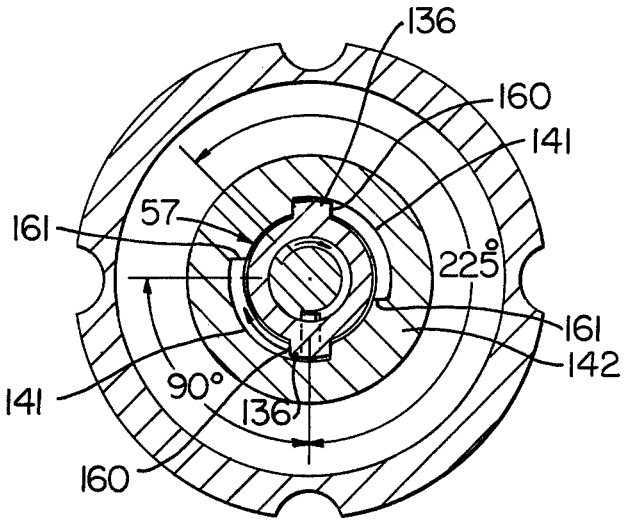
FIG. 20 is a view taken essentially on the line 20—20 of FIG. 4.

As seen in FIGS. 14 and 20 the projections 136 are received within a plurality of two cutout slots 141 in the central portion of a sleeve-like member 142 which is fixed to the structural member 54 by suitable means including a pin 143. The slots 141 in the central portion of member 142 extend through 90 degrees; however, at the outer end of member 142 slot portions 144 of limited axial length 145 (FIG. 14) are provided as diametrically opposed keyways 144. The keyways 144 receive projections 137 therein, see FIG. 15. The two projections 140 are received within a cooperating pair of spaced keyways 146 provided in a ring 147 suitably fixed to housing member 52.

The reduced diameter end portion 133 of the shaft 56 has a cutout 148 in its terminal outer end which receives a guide pin 149 therewithin for a purpose which will be apparent subsequently. The guide pin 149 has a rod-like end 150 which is received in a tubular extension 151 in the member 135 and the rod-like end 150 is slidably received within the tubular extension 151 and guided thereby for axial sliding movements thereof. A compression spring 152 is provided and acts between the member 135 of the clutch 57, the terminal ends of the main shaft 56 and serves to continuously yieldingly urge member 135 of the clutch 57 outwardly.

Figure 19:
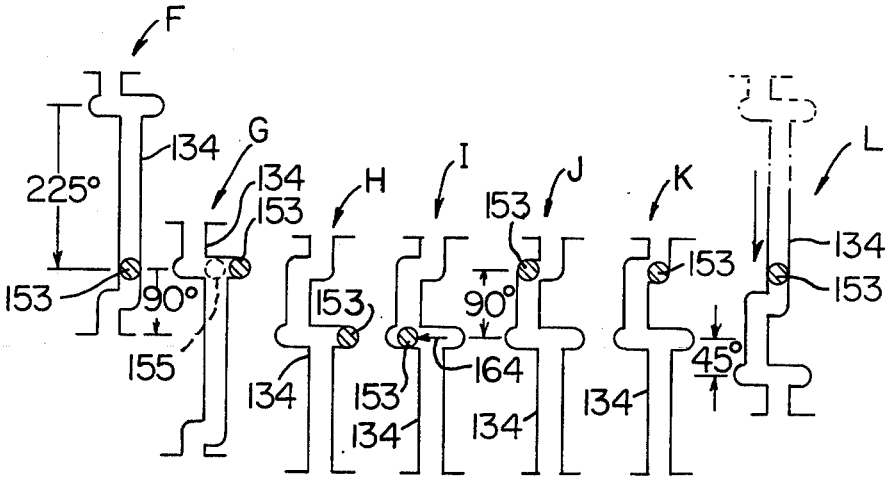
FIG. 19 is a schematic cycle diagram illustrating in plan view the relative positions of a cam track on the convertor main shaft and a guide pin on the clutch mechanism at a plurality of positions during a complete operating cycle, including reset.

The member 135 of the clutch 57 has what will be referred to as a cam guide pin 153 which is a solid right circular cylindrical pin which is suitably fixed thereto and the guide pin 153 is particularly adapted to move in the cam track 134 machined in the terminal end portion 133 of the main shaft 56. During operation of the code convertor 35 and in this particular embodiment of the invention during receipt of 20 mechanical input pulses in accordance with the code the main shaft 56 is incrementally indexed 225 degrees as illustrated in FIG. 19 view F and G which show the cam track 134 in plan view and 225 degree movement of such track from the initial position thereof to the final position thereof. During this phase of operation the output shaft 43 and hence cam pin 153 remains stationary because shaft 43 is locked to the housing and support structure 50 by projections 137 and 140 being prevented from rotating by structure of members 142 and 147 defining keyways 144 and 146 respectively. Under these conditions the guide pin 149 is under spring load by the compression spring 152. However, it will be appreciated that clutch member 135 is prevented from moving axially outwardly because the cam guide pin 153 is confined by a structural wall portion of shaft 56 which defines the cam track 134.

After receiving 20 correct mechanical input pulses the main shaft 56 and thus cam track has moved (guide pin 153 is stationary all this time) to position illustrated in view G of FIG. 19 whereupon guide pin 153 of the clutch 57 now is urged in a snap motion by the spring 152 through dotted line position 155 illustrated in view 19G to the solid line position in such view. This action moves the clutch structure to the position illustrated in FIG. 17 and uncouples the clutch 57 from the housing and support structure 50 and through the action of the guide pin 149 urges surface 157 of the projections 140 into engagement with an annular surface 158 of the output shaft 43 whereby clutch 57 is now in essence, coupled to the main shaft 56 and uncoupled from structure, i.e., the housing and support structure 50 of the code converter 35.

Correctly coded mechanical driving movements will now rotate main shaft 56 with the output shaft 43 directly coupled thereto through an angular increment of 90 degrees-position of view 19G to the position illustrated in view 19H. However, further rotation of the output shaft and main shaft 56 is prevented because surfaces 160 of projections 136 engage cooperating surfaces 161 (FIG. 20) defining side surfaces of slots 141 in member 142. At this point reverse rotation of the output shaft 43 and main shaft 56 is prevented by the locking pawls 90.

The code convertor is now in the desired position and in view 19H may be considered in the final position lock shown in FIG. 1. At this point the output shaft has rotated 90 degrees and being suitably nondetachably coupled to shaft 31 of munition 30 by mechanical connection 44 has armed munition 30.

Figure 18:
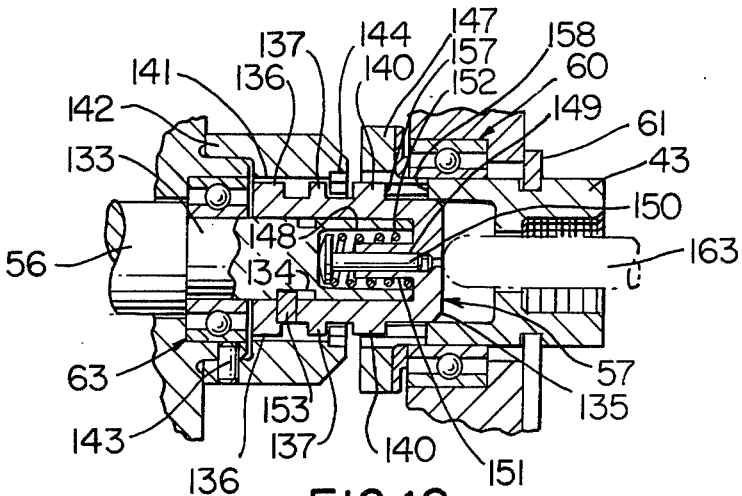
FIG. 18 is a view similar to FIGS. 14 and 17 illustrating the resetting of the clutch mechanism using a resetting tool.

The code convertor 35 has suitable reset means enabling resetting thereof with output shaft 43 directly coupled to linkage mechanism 44 and without disassembly of any operating components. The reset operation is carried out as shown in view 19I and FIG. 18. In this example a reset tool 163 is manually actuated and used to override the compression spring 152 as shown schematically by the arrow 164 in view 19I. With the spring 152 held inwardly the output shaft and member 135 with its guide pin 153 are rotated backwards 90° or in reverse an equivalent of eight mechanical input pulses as shown in view 19J. Upon moving 90° the reset tool 163 is removed whereupon the compression spring 152 takes over moving the member 135 of clutch 57 outwardly and the cam guide pin to the position illustrated in view 19K. Four more input pulses are now applied and result in 45° of rotation of shaft 56 for completion of 32 teeth and the placement of the guide pin 153 in the cam track 134 which as shown in view 19L is the initial position thereof.

Resetting from an abort mode requires a manual lifting of the abort locking pawls 91. This will return the lock ratchets 70L and 70R to their initial relationship with the drive ratchets 72L and 72R under the influence of springs 110 bearing against transfer pins 80. This also releases the locking protrusions 76L (or 76R) of the lock ratchets 70L (or 70R) with the locking hook 84L (or 84R) of the lock arm 71L (or 71R). The unit is now out of the abort mode, but is partially advanced. Upon completion of the code, reset is completed as in above. Visual access to the code can be provided with view windows (not shown).

The code in this example is in accordance with a binary system, however, it will be appreciated that such code can be in accordance with any system including a complex mathematical formula, or the like. Nevertheless, regardless of the code the key concept of this invention is that the code is applied through a mechanical code convertor in order to provide motion of an output member which in this example is in the form of output shaft 43.

In this example the code for the first 20 bits was selected using a random number table with odd numbers being assigned a "1" and even numbers being assigned a "0". The drive ratchets were then coded or machined so that a "1" corresponds to a clockwise rotation of torque motor 34 and a left drive pawl 67L index while a "0" corresponds to counterclockwise rotation of a torque motor 34 and a right drive pawl 67R index.

The complete code of this example is presented in the following table.

CODE TABLE

| Verifying Code | | Drive | | Reset | |
|---|---|---|---|---|---|
| Bit | Code | Bit | Code | Bit | Code |
| 1 | 1 | 21 | 1 | 29 | 0 |
| 2 | 0 | 22 | 0 | 30 | 0 |
| 3 | 1 | 23 | 1 | 31 | 0 |
| 4 | 1 | 24 | 0 | 32 | 0 |
| 5 | 1 | 25 | 1 | | |
| 6 | 0 | 26 | 0 | | |
| 7 | 1 | 27 | 1 | | |
| 8 | 0 | 28 | 0 | | |
| 9 | 0 | | | | |
| 10 | 1 | | | | |
| 11 | 1 | | | | |
| 12 | 0 | | | | |
| 13 | 1 | | | | |
| 14 | 0 | | | | |
| 15 | 0 | | | | |
| 16 | 0 | | | | |
| 17 | 1 | | | | |
| 18 | 1 | | | | |
| 19 | 0 | | | | |
| 20 | 0 | | | | |

The above code is based on the utilization of lock ratchets having 32 teeth whereby 20 teeth are used to verify the code, 8 increments to rotate the output shaft 90°, and 4 increments to reset. However, it is to be understood that any number of teeth may be provided on the lock ratchets.

To assure that the code convertor 35 operates in a fail-safe manner the design philosophy employed utilizes what is commonly referred to in the art as a weak link-strong link philosophy. Accordingly, with such philosophy the design failure mode of key components is such that the drive pawls 67L and 67R fail first, the pin 46 fails next, the locking protrusions 76L and 76R fail next, and finally the locking hooks 84L and 84R of the lock arms.

There are a number of unique and unusual features associated with the structure just described. For example, to operate the output shaft, it is necessary to "drive through the code." That is to say the structure that verifies the code is connected in series to the output shaft and there can be no movement of the output shaft unless such movement comes from the coding or verifying means.

Further, it will be noted that the system provides for an active advance and a passive abort. Unless something moves in response to a code stimulus, there is a failure, and the device aborts.

There is no stored arming energy that will cause accidential arming or movement of the output shaft in the event of a malfunction. To illustrate, there is no restrained spring which can be accidentally unleashed to arm the system. All movement of the output shaft occurs in response to an input signal.

The choice of code is completely unconstrained. Any code can be selected.

The design further allows for dynamic stability since all rotating members can be balanced.

Figure 6:
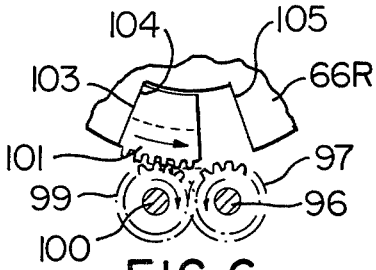
FIG. 6 is a view similar to FIG. 5 taken essentially on line 6—6 of FIG. 4.

Clearances in the reverse mechanical slots illustrated in FIGS. 5 and 6 are adjusted and controlled to prevent bypassing of the code in case of a malfunction. Normally 66L and 66R do not move together. If due to corrosion or some other malfunction, they do move together, the clearances are controlled so that neither members 101 nor 92 can go to their extreme positions.

The concept can be incorporated into a linear device and is not limited to a rotary structure. While a 90° output angle has been disclosed, this is not critical. The movement of the output shaft can be designed to pass through a wide range of angles at 45° to 120°, which is typical.

From the above description it will be seen that this invention provides a fail-safe mechanical code convertor, munition arming device using same, and a method of transmitting a coded mechanical input which employs a key concept of driving through a code in a manner heretofore unknown.

While present exemplary embodiments of this invention, and methods of practicing the same, have been illustrated and described, it will be recognized that this invention may be otherwise variously embodied and practiced within the scope of the following claims.

What is claimed is:

1. A fail-safe mechanical code convertor comprising:

input means for receiving complementary driving movements including a rotatable input member which is adapted to be rotated in one direction in response to one set of binary drive pulses and is adapted to be rotated in an opposite direction in response to the other set of binary drive pulses;

a pair of drive members responsive to said input means for converting said rotary movements of said input means into unidirectional binary mechanical movement; and a pair of coded drive mechanisms, each coupled to a drive member and responsive to an associated set of correctly coded drive pulses for producing an indexing rotary motion to a main shaft and responsive to an associated set of incorrect coded drive pulses to block the indexing rotary motion of said main shaft.

2. A mechanical code convertor as set forth in claim 1 and further comprising means holding said main shaft against rotation in a direction opposite from said one direction.

3. A mechanical code convertor as set forth in claim 2 in which said holding means comprises a plurality of locking pawls.

4. A mechanical code convertor as set forth in claim 1 and having a housing and support structure, and wherein said apparatus further comprises a clutch connected between said main shaft, said structure, and said output shaft.

5. A mechanical code convertor as set forth in claim 4 in which each of said pair of mechanisms comprises a drive member rotatable in an indexing manner about said main shaft, a drive pawl detachably fixed to its drive member for movement therewith, a lock ratchet rotatably carried on said main shaft, a lock arm pivotally supported adjacent its drive member and lock ratchet, a drive ratchet keyed to said main shaft and having teeth therein formed in accordance with a code that corresponds to said correctly coded driving movements, each of said drive pawls being adapted to engage and move an associated drive ratchet upon engagement of a tooth thereof, at lest one transfer pin interconnecting said locking ratchets, one of said drive ratchets presenting a tooth to an associated drive pawl being moved by its drive member during provision of said correctly coded driving movements to provide indexing rotation of said main shaft, each of said drive ratchets having a missing tooth and thus being ineffective in providing rotation of said main shaft during provision of said incorrectly coded driving movements, and a cam pin on each of said drive members which operates to lift its associated lock arm in response to a correctly coded driving movement such that with an incorrectly coded driving movement a lock arm remains stationary and engages its associated lock ratchet causing a self locking of the entire apparatus and code convertor.

6. A mechanical code convertor as set forth in claim 5 in which each of said lock ratchets has a plurality of locking projections therein which correspond to said correctly coded driving movements and said lock arm has a locking hook which engages an associated locking projection during provision of an incorrectly coded driving movement to provide said self locking.

7. A mechanical code convertor as set forth in claim 6 in which each of said lock arms has a projection which during indexing rotation of an associated drive member serves as a stop to limit the extend of movement of the associated drive member and hence its drive pawl and drive ratchet.

8. A mechanical code convertor as set forth in claim 4 in which said clutch has a main clutch member with a cam pin fixed thereto and said main shaft has a cam track formed therein, said cam track being adapted to be moved relative to said cam pin until a verifying code portion of said correctly coded mechanical driving movements has been transmitted through said apparatus, said clutch then unlocking said output shaft from said structure and connecting said output shaft to said main shaft for rotation therewith.

9. A mechanical code convertor as set forth in claim 8 in which said main member has at least one set of locking projections which serve to maintain said main member locked to said structure during rotary movement of said main shaft until said verifying code portion has been transmitted therethrough, and said clutch has means unlocking said main member from said structure and connecting same to said main and output shafts for simultaneous rotation of said main and output shafts upon rotation of said main shaft in response to a drive code portion of said correctly coded mechanical driving movements.

10. A mechanical code convertor as set forth in claim 9 and further comprising cooperating means in said main member and structure limiting the extent of angular rotation of said output shaft after connecting same to said main shaft.

11. A mechanical code convertor as set forth in claim 10 in which said structure has a ring fixed thereto, and said cooperating means comprises at least another projection on said clutch member and a cooperating stop on said ring.

12. A mechanical code convertor as set forth in claim 9 in which said means of said clutch unlocking said main member from said structure comprises a compression spring which is particularly adapted to move said main member after said provision of said verifying code portion.

13. A mechanical code convertor as set forth in claim 12 in which said output shaft has an opening therein which is particularly adapted to have a reset tool inserted therein for overriding said compression spring to enable locking said main member to said structure.

14. A fail-safe method of transmitting a coded mechanical input comprising the steps of:

providing two sets of binary drive pulses;

utilizing said binary drive pulses to generate a rotary drive pulse in one direction in response to one set of drive pulses and another set of rotary drive pulses in the opposite direction in response to the other set of drive pulses;

converting said rotary drive pulses to a pair of unidirectional rotary drive pulses; and using said pair of unidirectional rotary drive pulses to operate a pair of coded discs which produce indexing rotary motion in a shaft coupled to an output means in response to correctly coded unidirectional drive pulses and to block indexing rotary motion to said shaft in response to incorrect coded unidirectional rotary drive pulses.

15. A method as set forth in claim 14 in which said applying step comprises applying said complementary mechanical driving movements in the form of binary mechanical drive pulses.

16. A method as set forth in claim 15 in which said providing step comprises providing said code convertor having said input means in the form of a rotatable input member which is adapted to be rotated in one direction in response to one set of said binary mechanical drive pulses and is adapted to be rotated in an opposite direction and in response to the other set of said binary mechanical drive pulses.

17. A method as set forth in claim 16 and comprising the further step of connecting a reversible torque motor to said input member to enable rotation of said input member in opposed directions.

18. A method as set forth in claim 17 and comprising the further step of introducing a coded electrical signal from an optical-electronic device to said torque motor to provide direction of rotation thereof in accordance with said code.

* * * * *